US006427966B1

(12) United States Patent
Blumenschein

(10) Patent No.: US 6,427,966 B1
(45) Date of Patent: Aug. 6, 2002

(54) SUPPORT BASE FOR HOUSEHOLD APPLIANCES

(76) Inventor: Benjamin Blumenschein, Grabenstrasse 20, D-71404 Korb (DE)

( * ) Notice: Subject to any disclaimer, the term of this patent is extended or adjusted under 35 U.S.C. 154(b) by 0 days.

(21) Appl. No.: 09/382,741

(22) Filed: Aug. 25, 1999

(30) Foreign Application Priority Data

Aug. 26, 1998 (DE) ..... 198 38 631

(51) Int. Cl.[7] ..... F16M 1/00
(52) U.S. Cl. ..... 248/678; 248/646
(58) Field of Search ..... 248/678, 680, 248/635, 673, 346.01, 346.02, 151, 676, 127

(56) References Cited

U.S. PATENT DOCUMENTS 1,554,559 A * 9/1925 Corcoran ..... 248/678
2,266,852 A * 12/1941 Cunningham ..... 248/501
3,713,620 A * 1/1973 Tkach ..... 248/19
4,186,784 A * 2/1980 Stone ..... 248/646
4,738,425 A * 4/1988 Foster ..... 248/346
4,809,421 A * 3/1989 Justice ..... 248/678
5,131,621 A * 7/1992 Sdano ..... 248/680
5,176,437 A * 1/1993 Remington ..... 248/680
5,460,348 A * 10/1995 Cox ..... 248/635
5,549,056 A * 8/1996 Jordan et al. ..... 108/57.25
6,053,466 A * 4/2000 Jordan et al. ..... 248/346.01
6,126,131 A * 10/2000 Tietz ..... 248/346.01

FOREIGN PATENT DOCUMENTS

DE 297 10 601 U1 * 9/1997

* cited by examiner

*Primary Examiner*—Leslie A. Braun
*Assistant Examiner*—Gwendolyn Baxter
(74) *Attorney, Agent, or Firm*—Pendorf & Cutliff

(57) ABSTRACT

A support base for household appliances such as washing machines, dryers and dishwashers. The support base includes a support plate (18), which exhibits a set-up surface for setting up a household appliance with adjustable feet (12), with edge strips (24) bent downwards along the edge of the support plate. In the corner area of the support plate (18) support legs (20, 22) are provided projecting downwards, which are preferably comprised of sheet metal bent along a corner-edge. The set-up surface (16) of the support plate (18) exhibits a cup-like recess above each of the support legs (20, 22) for receiving respectively one of the foot parts (12) of the household appliance (14).

19 Claims, 2 Drawing Sheets

SUPPORT BASE FOR HOUSEHOLD APPLIANCES

BACKGROUND OF THE INVENTION

1. Field of the Invention

Figure 1:
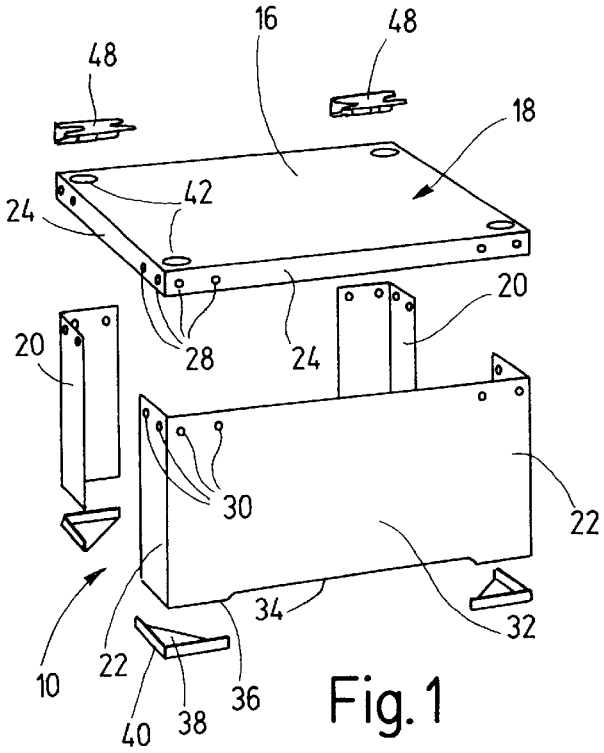

The invention concerns a support base for household appliances such as washing machines, dryers and dishwashers, with an essentially square or quadratic peripheral shape, a support plate with a set-up surface for setting up a household appliance with adjustable feet, with edge strips bent downwards along the 10 edge of the support plate and with support legs rigidly fixed to the corner areas of the support plate projecting downwards, preferably comprised of sheet metal bent along the corner.

2. Description of the Related Art

Household devices of the type described above must be set-up to be vertical to ensure a problem-free operation. In order to level the device, generally adjustable feet designed as threaded feet are provided for compensating for a non-planar floor. The working height of the household device can, however, not be significantly adjusted via these adjustment elements. It can be considered a disadvantage, that the construction height of the conventional household devices is not optimal. This disadvantage can be overcome by utilization of support bases, as known for example from DE-GM 29710601 and 29714220. The known support bases are provided with security pieces for support stability of the household device, which are slideable in diagonally oriented longitudinal holes in the support plate and are fixable thereto. It has been found that during the assembly and set-up of the support base a substantial effort is required for assembly of the securing pieces. The securing pieces must be assembled precisely, in order to prevent the displacement of the household appliance on the support plate.

Beginning herewith it is an object of the invention to improve the support base of the type described above in such a way, that the assembly of the support base and the set-up of the household appliance on the support base is simplified.

SUMMARY OF THE INVENTION

A first inventive characteristic of the invention is comprised therein, that the set-up surface of the support plate exhibits a cup-like recess above each respective support leg for receiving respectively one of the foot parts of the household appliance. The cup-like recesses can be stamped or impressed into the support surface. They preferably exhibit a flat base or floor and a cylindrical or conical rim. In each cup-like recess a drainage hole should be provided on the floor thereof, such that any water which may enter at some time in the future may run off.

According to a preferred embodiment of the invention, two adjacent support legs are joined or connected to each other unitarily along the flank of the corner facing each other, thereby forming an optical shield. In order to compensate for uneven floors, it is preferable that the optical shield is provided such that its lower edge is recessed towards the back with respect to the corner or edges of the foot of the support legs. The support legs are preferably secured, via threaded fasteners, along the upper ends of their corner-forming flanks to respectively two adjacent corner edge strips of the support plate.

According to a preferred or alternative embodiment of the invention, multiple securing means are form-fittingly provided releasably securing and form-fittingly engaging respectively one of the adjustable feet of the household appliance. The securing means are preferably constructed as angle-pieces, with a securing flank which can be screwed onto one of the edge strips of the support plate, and a holding-down flank extending over one of the adjustable feet of the household appliance. The holding-down flank exhibits an edge-open through-hole for receiving one of the adjustment spindles of the adjustable feet. A reliable connection between the support base and the household appliance is achieved, when the through-hole in the holding-down flank is formed as an edge-open longitudinal hole oriented parallel to the corner-edge of the securing means. Preferably, the holding-down flanks are each provided with two edge-open through-holes on opposing sides. The assembly of the securing means is simplified, when the screw holes in the securing flank of the securing means are formed as longitudinal holes running essentially parallel to the corner-edge. Because of the allowable variation occurring during the manufacture of the cup-like recesses and the foot parts, it is advantageous, when the longitudinal holes, in their central area, run diagonal to the corner edge. In this manner one can take advantage of the wedge or shim effect of the diagonal longitudinal holes for supplementally providing a form-fitting connection between the support base and the adjustable feet.

For improving stability, it can, be of advantage when each support leg is provided with a base plate which can be set on the ground and preferably secured thereto, which base plate includes a bent-up edge area, and upon which the support leg can be seated at its foot edge.

A BRIEF DESCRIPTION OF THE DRAWINGS

In the following the invention will be described in greater detail on the basis of the illustrative embodiment shown in schematic man he drawings.

Figure 2:
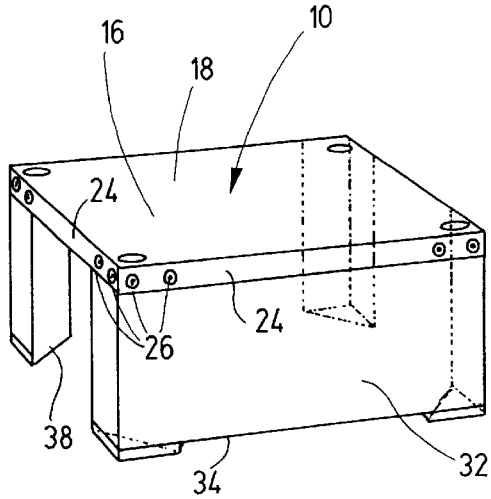
Figure 3A:
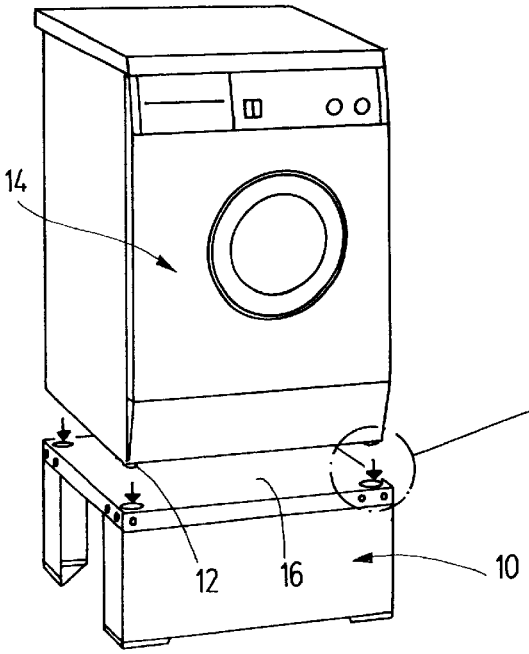
Figure 3B:
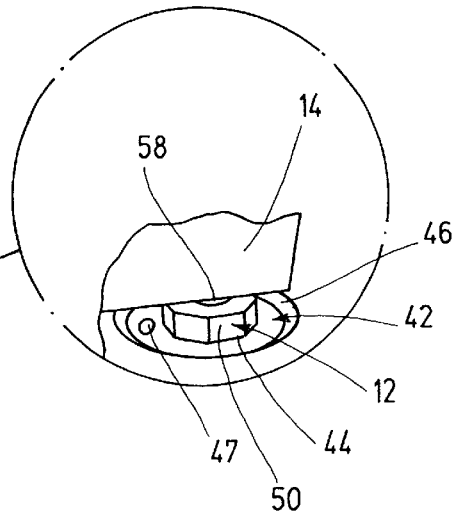

FIG. 1 a perspective exploded representation of a support base for: a household appliance;

FIG. 2 the support base according to FIG. 1 in assembled condition;

FIG. 3*a* the support base according to FIG. 2 in the case of setting up of a washing machine;

FIG. 3*b* an enlarged section from FIG. 3*a;*

Figures 4A, 4B, 4C:
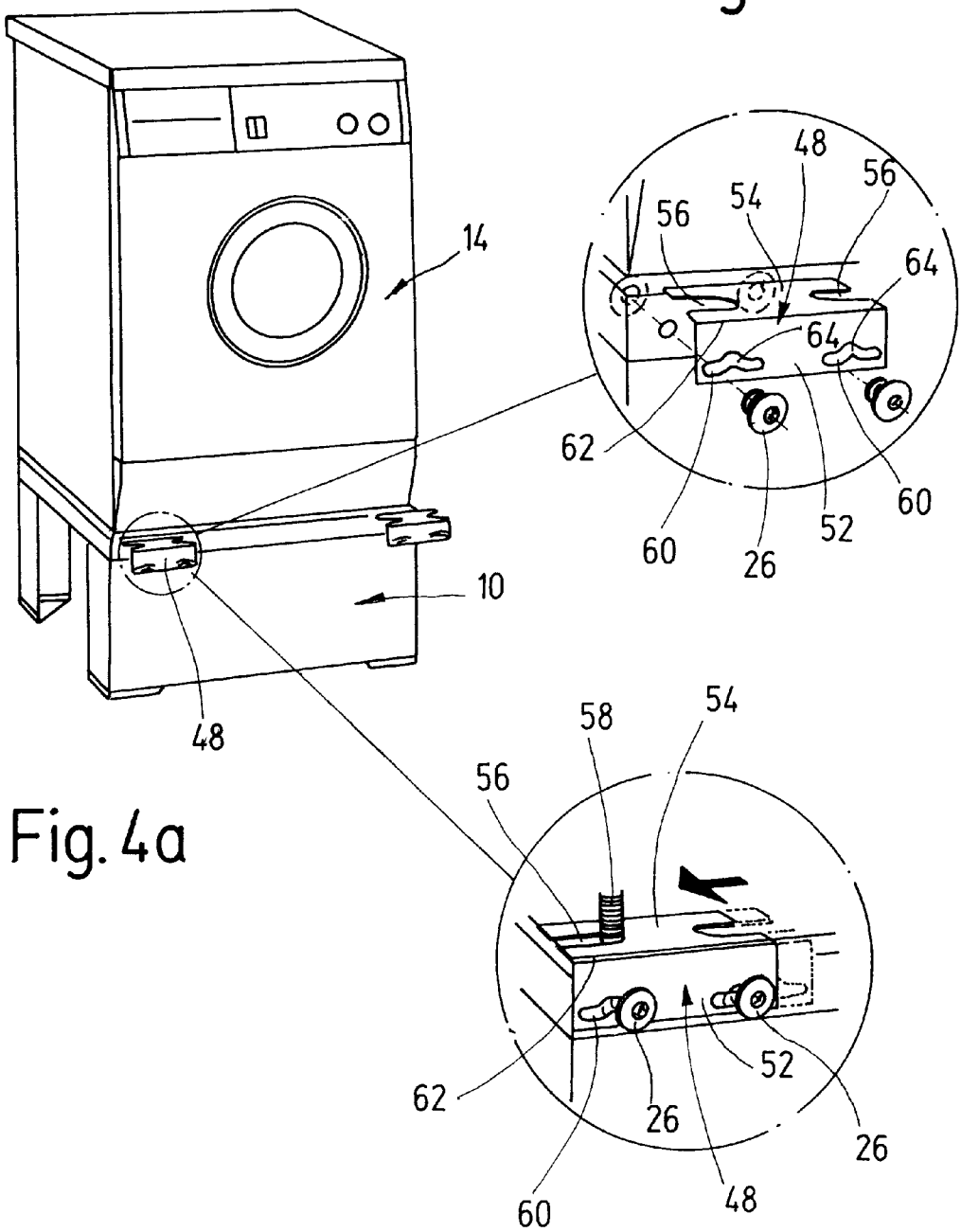

FIGS. 4*a* through *c* the support base with set-up washing machine showing the sequence of the assembly of the securing means.

DETAILED DESCRIPTION OF THE INVENTION

The support 10 shown in the drawings serves as a sub-base for a household appliance with adjustable feet 12, which is shown by way of example in the drawings as a washing machine 14.

The support base is comprised essentially of a support plate 18 with a square or quadratic periphery having a set-up surface 16 for the washing machine 14, two rear support legs 20, and two front support legs 22. The support plate is provided along its edges with downwardly directed edge strips 24, to which the support legs 20, 22 are rigidly securable by means of screws 26 which extend through boreholes 28, 30. The support legs 20, 22 are comprised of sheet metal angled to form a corner, wherein the rear support legs 20 are separated from each other, while the front support legs 22 are unitarily connected with each other along the flanks of the corner facing each other, thereby forming an optical shield or skirt 32. The skirt 32 is recessed or elevated on its lower edge 34 with respect to the foot corners 36 of the support legs 22. The foot corners 36 of the support legs 20, 22 stand on a base plate 38, which has a triangular periphery and a bent-up corner edge 40, which base plate can be secured to the ground by screwing.

In the set-up surface 16 of the support plate 18 there is formed above each of the support legs 20, 22 a cup-like recess 42, which has a planar floor 44 and a conical rim 46 into which respectively one of its adjustable feet 12 of the washing machine 14 can be introduced (FIGS. 3*a* and *b*). The recesses 42 are provided with drainage holes 47 in their floor 44.

For anchoring of the washing machine 14 to the support base 10 against sliding, supplemental securing means 48 are proposed, which in the assembled condition form-fittingly engage the plate-shaped foot parts 50 of the adjustable feet and of which one part is securable to the support base 10 via screws 26. The retaining means 48 are preferably designed as corner or angle pieces with a securing flank 52 which can be attached to the edge strips 24 of the support plate 18 by threaded fasteners, and a hold-down flank 54 for engaging the plate-shaped foot parts 50. The hold-down flanks 54 exhibit two opposing edge-open through-holes 56 on opposing sides, which are adapted for introduction of the adjustment spindle 58 of the adjustment foot 12. In the securing flank 52 there are longitudinal holes 60, which are oriented essentially parallel to the corner-edge 62 of the securing means 48 and which in their central area 64 are bowed diagonally to the corner-edge. Thereby it is possible to introduce the securing means 48 onto the adjustment foot from one side and to secure it to the support base 10 with one of the screw pairs 26. The diagonal 64 makes possible a compensation for construction dimensional variations and at the same time makes possible a force-fitting connection with the plate-shaped foot part 50.

In summary the following is to be concluded: The invention concerns a support base for household appliances such as washing machines, dryers and dishwashers. The support base includes a support plate 18, which comprises a set-up surface for setting up a household appliance with adjustable feet 12, and edge strips 24 bent downwards along the edge of the support plate. In the corner areas of the support plate 18 support legs 20, 22 are provided projecting downwards, which are preferably comprised of sheet metal bent along a corner-edge. The set-up surface 16 of the support plate 18 above each of the support legs 20, 22 exhibits a cup-like recess for receiving respectively one of the foot parts, 12 of the household appliance 14.

What is claimed is:

1. A support base for household appliances, said support base having an essentially quadratic peripheral shape, a support plate (18) with a set-up surface (16) adapted for setting up a household appliance (14) with adjustable feet (12) adjustable via adjustment spindles (58), edge strips (24) bent downwards along the edge of the support plate (18), and support legs (20, 22) rigidly fixed to the corner areas of the support plate and projecting downwards therefrom, wherein the set-up surface (16) of the support plate (18) above each of the support legs. (20, 22) exhibits cup-shaped recesses (42) adapted for receiving respectively one of the feet (12) of the household appliance (14), wherein multiple securing means (48) are provided on the support plate (18) adapted for releasably and form-fittingly engaging respectively one of the, adjustable feet (12) of the household appliance (14), wherein the securing means (48), constructed as an angle-piece angled along a corner-edge, is provided with a securing flank (52) which can be fastened to the edge strip (24) of the support plate (18) via screws, and a holding-down flank (54) adapted for extending over one of the adjustable feet (12) of the household appliance, wherein the holding-down flank (54) exhibits at least one edge-open through-hole (56) for receiving one of the adjustment spindles (58) of the adjustable feet (12), wherein the through-hole (56) in the holding-down flank (54) is formed as an edge-open longitudinal hole oriented parallel to the corner-edge of the securing means (48), and wherein the holding-down flank (54) is provided with two edge-open through-holes (56), on opposing sides.

2. A support base according to claim 1, wherein the cup-shaped recesses (42) are impressed or stamped into the support plate (18).

3. A support base according to claim 1, wherein the cup-shaped recesses (42) exhibit a planar floor (44).

4. A support base according to claim 1, wherein the cup-shaped recesses (42) exhibit a cylindrical or conical side wall.

5. A support base according to claim 1, wherein each cup-shaped recess (42) includes a floor, and wherein a drainage hole (47) is provided in said floor.

6. A support base according to claim 1, wherein said support legs include flanks, and wherein two adjacent support legs (22) are unitarily connected to each other along flanks facing each other, thereby forming an optical shield (32).

7. A support base according to claim 6, wherein said support legs; include foot corners (36), wherein said optical shield (32). includes a lower-edge (34) extending between said foot corners, and wherein said optical shield lower edge is recessed with respect to the foot corners (36) of the support legs (22).

8. A support base according to claim 1, wherein the support legs (20, 22) are secured at their upper ends of their corner flanks to respectively two adjacent corner edge strips (24) of the support plate.

9. A support base as in claim 1, wherein said household appliances are selected from the group consisting of washing machines, dryers and dishwashers.

10. A support base as in claim 1, wherein said support legs (20, 22) are comprised of sheet metal bent along the corner-edge.

11. A support base for household appliances, said support base having an essentially quadratic peripheral shape, a support plate (18) with a set-up surface (16) adapted for setting up a household appliance (14) with adjustable feet (12) adjustable via adjustment spindles (58), said support plate (18) including an edge strip (24), edge strips (24) bent downwards along the edge of the support plate (18), and support legs (20, 22) rigidly fixed to the corner areas of the support plate and projecting downwards therefrom, wherein the set-up surface (16) of the support plate (18) above each of the support legs (20, 22) exhibits cup-shaped recesses (42) adapted for receiving respectively one of the feet (12) of the household appliance (14.), wherein multiple securing means (48) are provided on the support plate (18) adapted for releasably and form-fittingly engaging respectively one of the adjustable feet (12) of the household appliance (14), wherein the securing means (48), constructed as an angle-piece angled along a corner-edge, is provided with a securing flank (52) which can be fastened to the edge strip (24) of the support plate (18) via screws, and a holding-down flank (54) adapted for extending over one of the adjustable feet (12) of the household appliance, wherein the holding-down flank (54) exhibits at least one edge-open through-hole (56) for receiving one of the adjustment spindles (58) of the adjustable feet (12), and wherein longitudinal holes (60) in the securing flank (52) are bowed in their central area (64) diagonal to the corner-edge (62).

12. A support base as in claim 11, wherein said household appliances are selected from the group consisting of washing machines, dryers and dishwashers.

13. A support base as in claim 11, wherein said support legs (20, 22) are comprised of sheet metal bent along the corner-edge.

14. A support base for household appliances, said support base having an essentially quadratic peripheral shape, a support plate with a set-up surface (16) adapted for setting up a household appliance (14) with adjustable feet (12) adjustable via adjustment spindles (58), edge strips bent downwards along the edge of the support plate (18) and support legs (20,22) rigidly connected to the corner areas of the support plate and projecting downwards, wherein on the support plate (18) multiple securing means (48) are provided adapted to form-fittingly and releasably engaging respectively one of the adjustable feet (12) of the household appliance (14)

wherein the securing means (48), constructed as an angle-piece angled along a corner-edge, is provided with a securing flank (52) which can be fastened to the edge strip (24) of the support plate (18) via screws, and a holding-down flank (54) extending over one of the adjustable feet (12) of the household appliance, wherein the holding-down flank (54) exhibits at least one edge-open through-hole (56) adapted for receiving one of the adjustment spindles (58) of the adjustable feet (12), wherein the through-hole (56) in the holding-down flank (54) is formed as an edge-open longitudinal hole oriented parallel to the corner-edge of the securing means (48), and wherein the holding-down flank (54) is provided with two edge-open through-holes (56), on opposing sides.

15. A support base as in claim 14, wherein said household appliances are selected from the group consisting of washing machines, dryers and dishwashers.

16. A support base as in claim 14, wherein said support legs (20, 22) are comprised of sheet metal bent along the corner-edge.

17. A support base for household appliances, said support base having an essentially quadratic peripheral shape, a support plate with a set-up surface (16) adapted for setting up a household appliance (14) with adjustable feet (12) adjustable via adjustment spindles:(58), edge strips bent downwards along the edge of the support plate (18) and support legs (20,22) rigidly connected to the corner areas of the support plate and projecting downwards, wherein on the support plate (18) multiple securing means (48) are provided adapted to form-fittingly and releasably engaging respectively one of the adjustable feet (12) of the household appliance (14)

wherein the securing means (48), constructed as an angle-piece angled along a corner-edge, is provided with a securing flank (52) which can be fastened to the edge strip (24) of the support plate (18) via screws, and a holding-down flank (54) extending over one of the adjustable feet (12) of the household appliance, wherein the holding-down flank (54) exhibits at least one edge-open through-hole (56) adapted for receiving one of the adjustment spindles (58) of the adjustable feet (12), and wherein longitudinal holes (60) in the securing flank (52) are bowed in their central area (64) diagonal to the corner-edge (62).

18. A support base as in claim 17, wherein said household appliances are selected from the group consisting of washing machines, dryers and dishwashers.

19. A support base as in claim 17, wherein said support legs (20, 22) are comprised of sheet metal bent along the corner-edge.

* * * * *